US005575535A

United States Patent [19]

Burchett et al.

[11] Patent Number: 5,575,535

[45] Date of Patent: Nov. 19, 1996

[54] COUCH WITH RETRACTABLE GUARD MEMBER

[76] Inventors: Mark R. Burchett, 1521 Lariat; Samuel W. Bibles, 712 SE. Sooner Park Dr., both of Bartlesville, Okla. 74006

[21] Appl. No.: 517,920

[22] Filed: Aug. 22, 1995

[51] Int. Cl.[6] ..... A47C 31/00

[52] U.S. Cl. ..... 297/464; 297/487; 297/488; 297/146; 297/163; 5/428

[58] Field of Search ..... 297/464, 487, 297/488, 146, 163; 5/425, 428, 430

[56] References Cited

U.S. PATENT DOCUMENTS

| | | | |
|---|---|---|---|
| 2,619,395 | 11/1952 | Kent | 297/146 |
| 2,703,413 | 3/1955 | Klebanoff | 5/425 X |
| 2,722,017 | 11/1955 | Burst et al. | 5/428 |
| 3,063,066 | 11/1962 | Peck et al. | 5/430 |
| 3,419,922 | 1/1969 | Malherbe | 5/430 |
| 3,743,351 | 7/1973 | Harris | 297/107 |
| 3,893,731 | 7/1975 | Maggs | 297/396 |
| 3,910,630 | 10/1975 | Runyon et al. | 297/63 |
| 4,158,713 | 6/1979 | Degens | 428/212 |
| 4,447,920 | 5/1984 | Rosen | 5/12 R |
| 4,811,436 | 3/1989 | Schwartz | 5/428 X |
| 4,993,089 | 2/1991 | Solomon et al. | 5/428 X |
| 5,129,117 | 7/1992 | Celestina et al. | 5/430 X |
| 5,187,824 | 2/1993 | Stryker | 5/430 |

*Primary Examiner*—Peter M. Cuomo
*Assistant Examiner*—Stephen Vu
*Attorney, Agent, or Firm*—Joseph N. Breaux

[57] ABSTRACT

An improved couch is provided of the type having a base, a first and second opposing arm rest, a back portion, a seating surface and a front couch surface. The improvement to the couch comprises: a front guard detachably connectable to the front couch surface for enclosing a portion of the seating surface on three sides, the front guard may be retractable for storage beneath the couch, and a tray may be extendable from the front guard for placing objects such as food, drinks, books, remote controls and the like.

5 Claims, 5 Drawing Sheets

COUCH WITH RETRACTABLE GUARD MEMBER

TECHNICAL FIELD

The present invention relates to devices for enclosing a portion of a seating surface of a couch and more particularly to devices for enclosing a portion of a seating surface of a couch with a front guard which is detachably connectable to the front couch surface.

BACKGROUND ART

In the majority of homes, the occupants have a conventional couch or sofa which has a seating surface, opposing arm rests and a back rest. However, the front of the seating surface of these couches are unguarded presenting the danger of an unattended infant falling from the seating surface. In addition, when a person is injured, very sick and weak or physically or mentally disabled the couch does not provide a safe surface for the person to occupy. It is also common for a person who has fallen asleep on the seating surface to roll off the front of the couch.

It is often desirable for a person to sit-up along the longitudinal axis of the seating surface with their feet on the seating surface to watch TV or read a book. This may be uncomfortable due to not having a place on the front surface of the couch to rest the person's arm. In addition, from this position a table is often not accessible to place a drink, food, a remote control or other objects.

It would be a benefit, therefore, to a have a front guard detachably connectable to the front couch surface. It would be a further benefit to have a front guard which may be retracted and stored beneath the couch. It would still be a further benefit to have a tray which is perpendicularly extendable from the guard.

GENERAL SUMMARY DISCUSSION OF INVENTION

It is thus an object of the invention to provide a improved couch that has a guard detachably connectable to the front surface of the couch.

It is a further object of the invention to provide a improved couch that has a detachable guard which covers between 15 to 50 percent of the front surface of the couch.

It is a still further object of the invention to provide a improved couch that has a front guard which may be retracted and stored beneath the couch.

It is a still further object of the invention to provide a improved couch that has a tray perpendicularly extendable from the detachable front guard.

Accordingly, an improved couch is provided of the type having a base, a first and second opposing arm rest, a back portion, a seating surface and a front couch surface. The improvement to the couch comprises: a front guard detachably connectable to the front couch surface for enclosing a portion of the seating surface on three sides.

The front guard has a rigid interior frame which may me made of wood, metal or plastic. The frame is covered with material matching the couch covering. The interior of the guard may be padded with foam.

The front guard may extend from about ground level to the top of the arm rests. The front guard may extend from about ground level to the top of the back portion. The guard may extend from an arm rest to about the mid-point of the couch. The guard may extend from an arm rest to a point covering about 15 percent of the front couch surface. Preferably, the guard covers at least a third of the front couch surface.

The front guard is detachably connected to the front couch surface. The guard may be detachable from the front couch surface and retractable and storable under the couch. In this configuration the guard is lockable in a vertical position parallel with the front couch surface. The guard may be locked in place by a hook and eyelet, a ratchet mechanism in connection between the couch and a retraction and storage mechanism, or rigidly held in position by any other device known in the art.

The front guard may include a tray movable from a closed position concealed within the guard to an open position extending perpendicularly from the guard. The tray may be held within the guard by opposing magnets or strips of hook and loop fasteners or by a zipper. The tray may extend perpendicularly from the interior surface of the guard being aligned horizontally above the seating surface. The tray may extend from the exterior surface of the guard. A tray may extend from the interior surface and a tray may extend from the exterior surface of the front guard.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
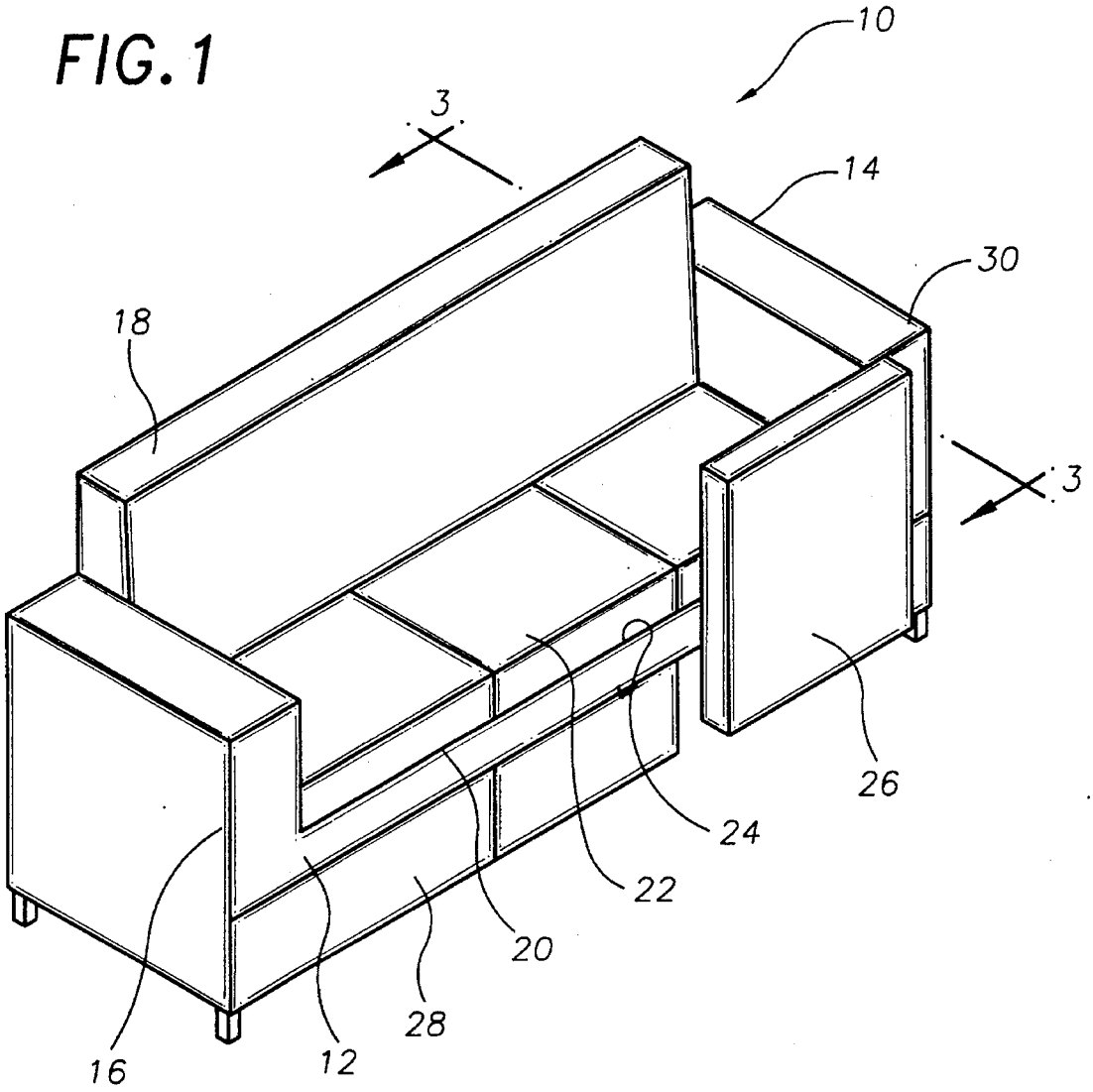
FIG. 1 is an isometric view of an exemplary embodiment of the improved couch of the present invention.

FIG. 1 is an isometric view of an exemplary embodiment of the improved couch of the present invention generally designated by the numeral 10. Couch 10 includes a base 12 having opposing first and second arm rests 14,16 and a back rest 18 defining a seating area 20 covered by removable cushions 22, a front couch surface 24, and a detachable front guard 26.

Couch 10 is a conventionally sized couch having arm rests 14 and 16 extending approximately mid-point back rest 18. Couch 10 comprises a unitary metal frame (not shown) covered with cloth entrapping a layer of foam padding. Skirts 28 hanger vertically from base 12 to approximately ground level.

Front guard 26 has a rectangular frame (not shown) covered with cloth matching couch 10. Guard 26 is sized to cover about a third of front couch surface 24 horizontally, and from about ground level to the top surface 30 of first arm rest 14 vertically. Guard 26 is detachably secured to couch 10 by a locking mechanism (not shown).

Figure 2:
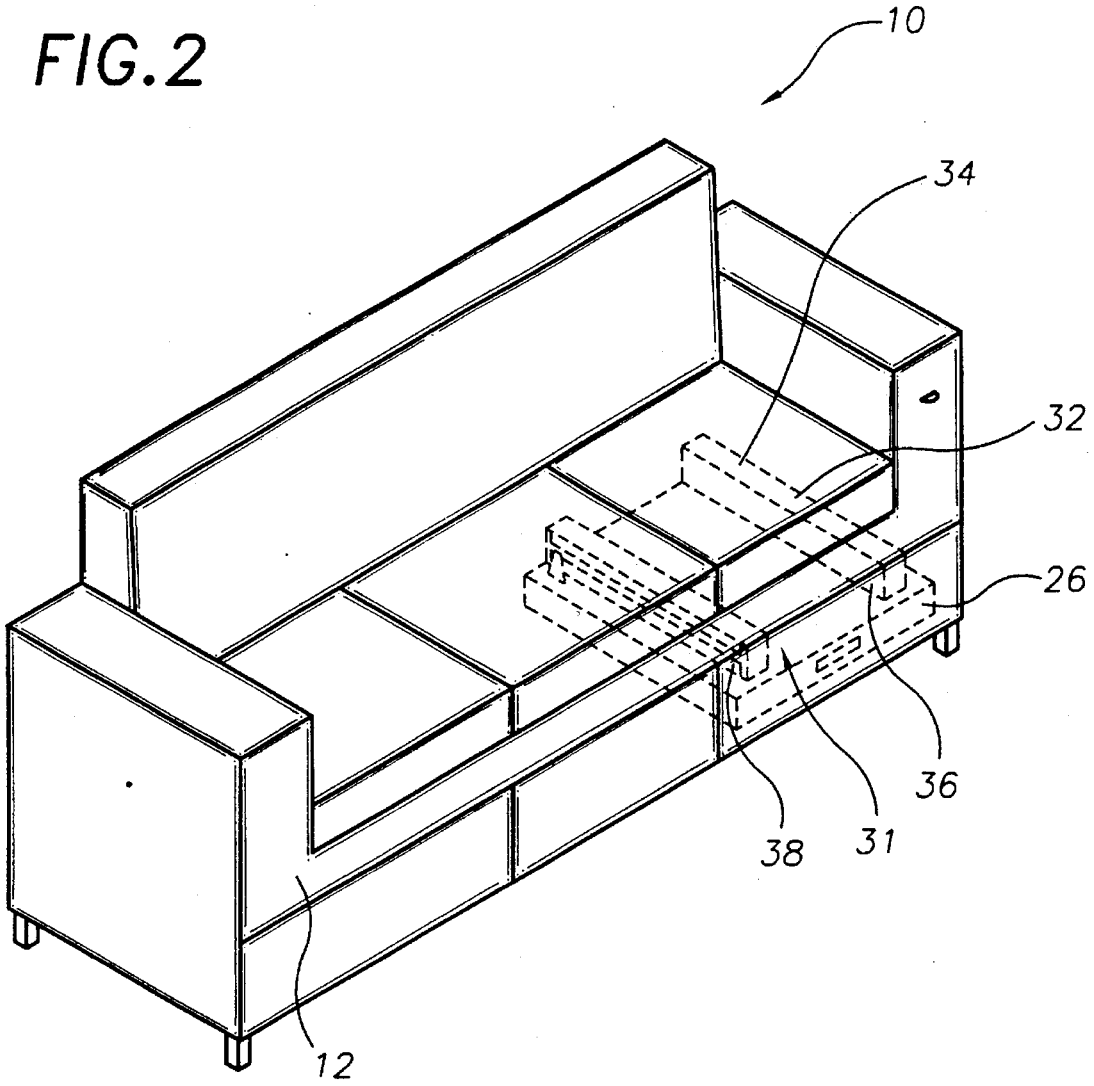
FIG. 2 is an isometric view of the couch 10 of FIG. 1 with the front guard held beneath the base of the couch on a storage and retraction mechanism.

FIG. 2 is an isometric view of couch 10 of FIG. 1 with guard 26 held beneath base 12 on a storage and retraction mechanism generally designated 31. Storage and retraction mechanism 31 includes two metal rails 32 having first surfaces 34, inner surfaces 36 and outer surfaces 38. Rails 32 are spaced parallel to one another with inner surfaces 36 opposed. First surfaces 34 of rails 32 are welded to the underside of base 12 along the transverse axis of couch 10.

Figure 3:
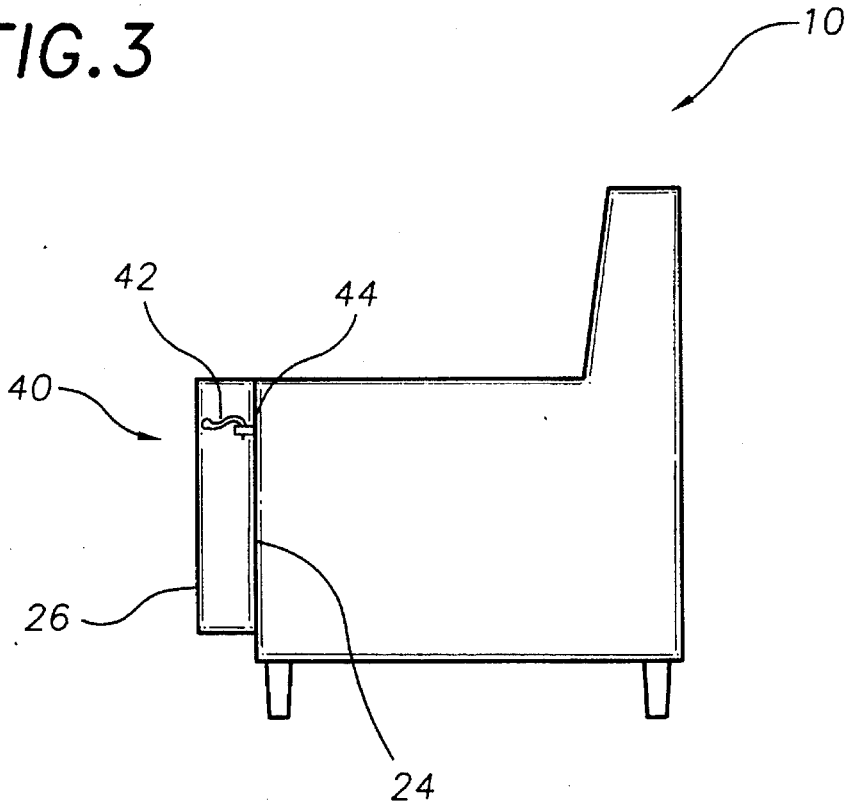
FIG. 3 is a side view of the couch along the line 3—3 shown in FIG. 1.

FIG. 3 is a side view of couch 10 along the line 3—3 shown in FIG. 1. Front guard 26 is extended from rails 32 (FIG. 2) and maintained in a vertical position along front couch surface 24 by a locking mechanism generally designated as 40. Locking mechanism 40 includes a hook 42 swivelly connected to guard 26 and engageable with an eyelet 44 extending from first arm rest 14.

Figure 4:
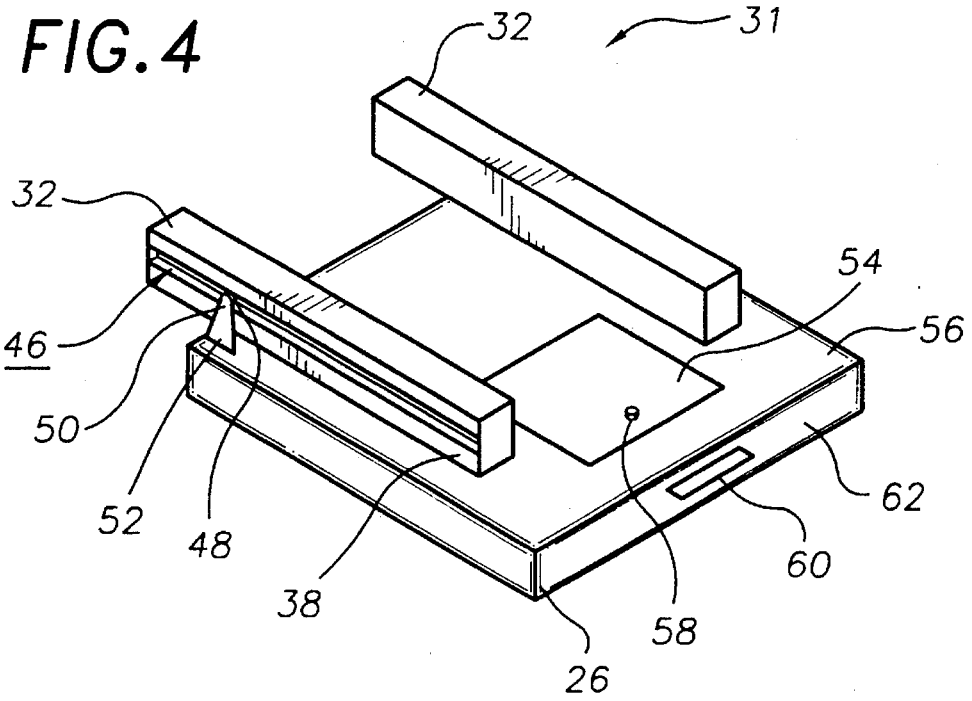
FIG. 4 is an isolated, isometric view of the storage and retraction mechanism.

FIG. 4 is an isolated, isometric view of storage and retraction mechanism 31. The figure shows rails 32 defining a channel 46 along the longitudinal axis of their outer surface 38. Channel 46 is coated with a hard plastic. A plastic wheel 48 is slidably entrapped within channel 46. Wheel 48 is rotatably connected by a pin 50 to bracket 52. Bracket 52 is connected the frame (not shown) of guard 26 by welding.

A tray 54 is shown in a closed position within the interior surface 56 of guard 26. A knob 58 is attached to tray 54 for folding tray 54 out. A handle 60 is attached to top surface 62 of door 26 for removing door 26 from its stored position as shown in FIG. 2.

Figure 5:
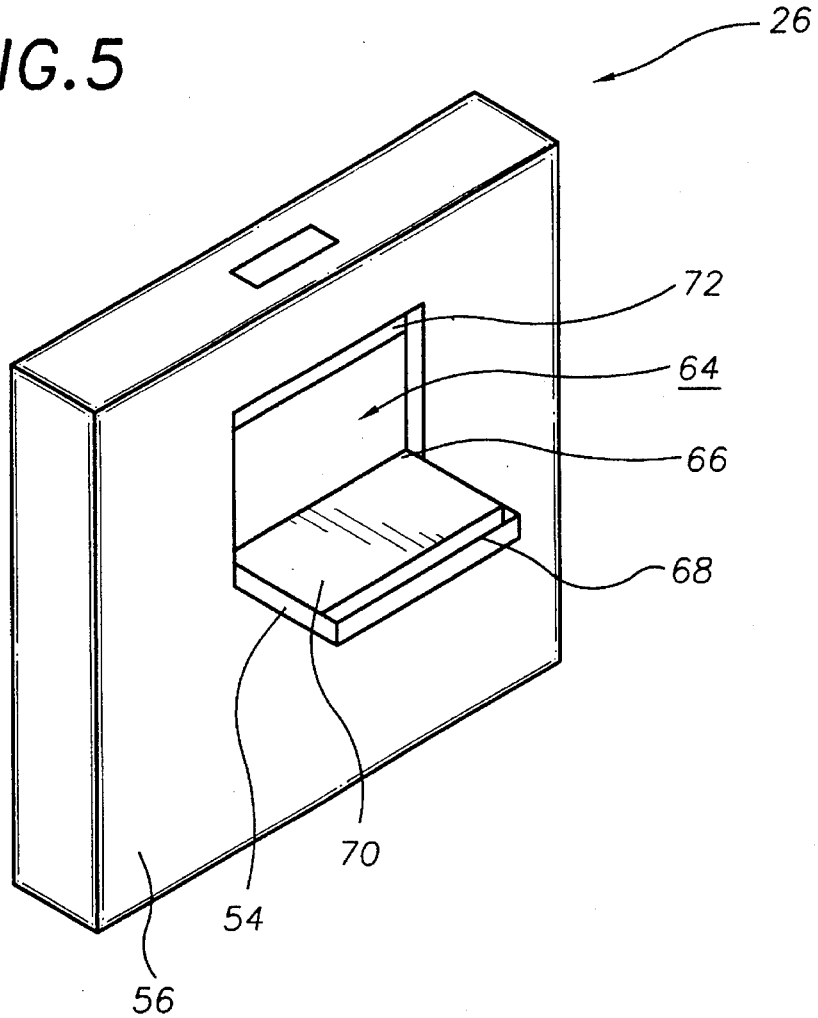
FIG. 5 is an isolated, isometric view of the guard.

FIG. 5 is an isolated, isometric view of guard 26. The figure shows interior surface 56 defining a chamber 64 for storing tray 54 in a closed position as shown in FIG. 4. Tray 54 is connected by a hinge 66 within chamber 64. Tray 54 is movable from a closed position as shown in FIG. 4 to an open position extending perpendicularly from door 26. A first strip of hook fasteners 68 is attached to tray surface 70 and is connectable with a second strip of loop fasteners 72 attached within chamber 64 for removably holding tray 54 in a closed position as shown in FIG. 4. Tray surface 70 is made of a hard, stain resistant plastic.

Figure 6:
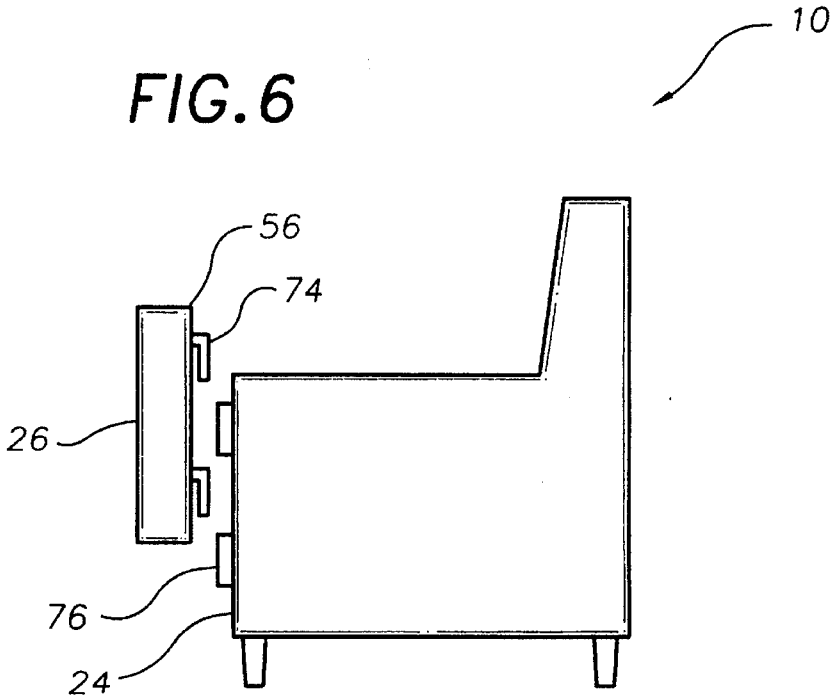
FIG. 6 is a side view of another exemplary embodiment of the improved couch of the present invention.

FIG. 6 is a side view of another exemplary embodiment of the improved couch of the present invention generally designated by the numeral 10. In this embodiment front guard 26 is detachable from front couch surface 24 for storage remote from couch 10. Guard 26 is detachably connected to front surface 24 by vertically oriented pins 74 extending from interior surface 56 which are disposable within shoots 76 attached to front couch surface 24.

Figure 7:
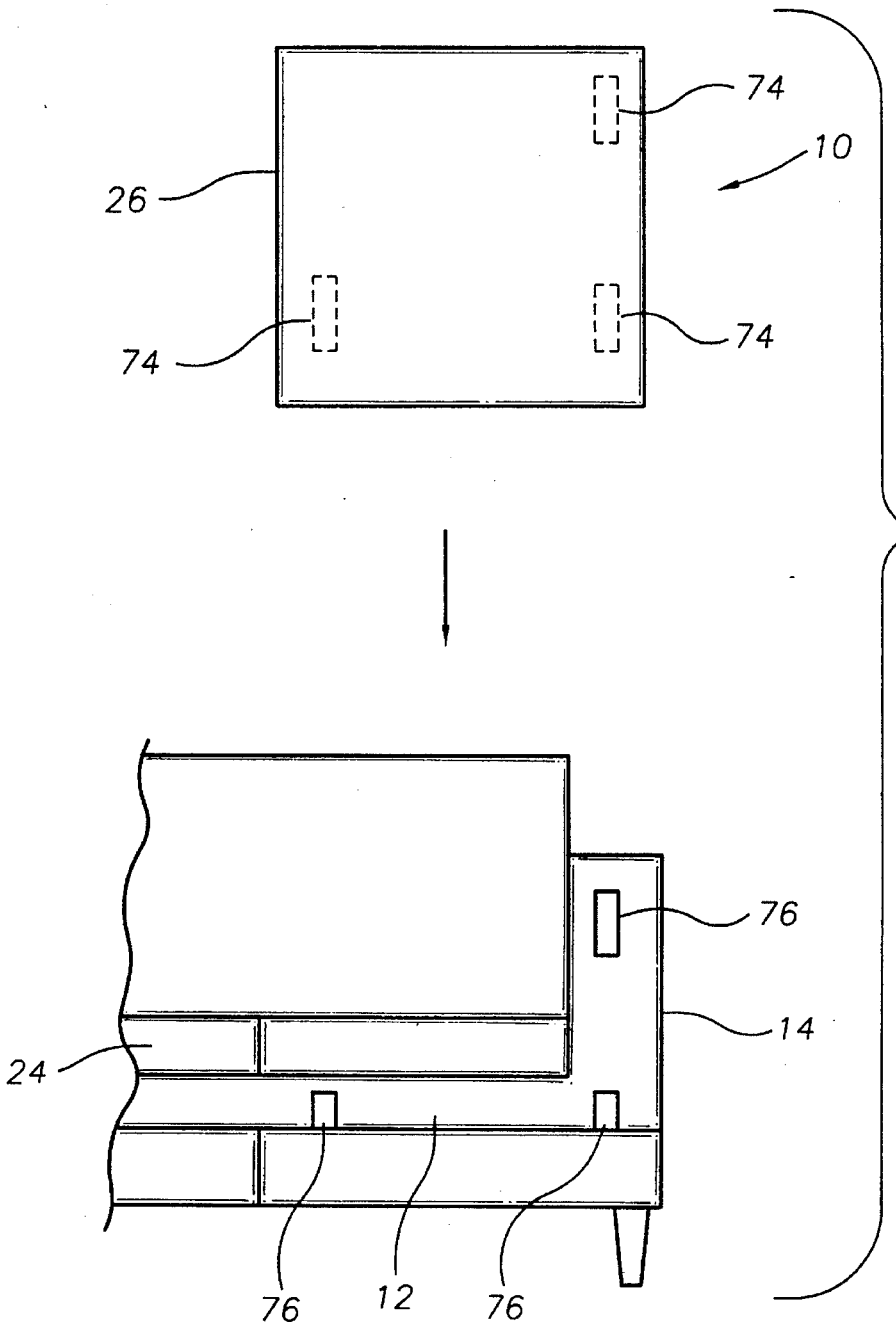
FIG. 7 is a front view of the couch as shown in FIG. 6.

FIG. 7 is a front view of couch 10 as shown in FIG. 6. The figure shows three shoots 76 aligned along the front couch surface 24 of first arm rest 14 and base section 12. Guard 26 is shown removed from couch 10 with pins 74 indicated by hidden lines.

Use of the improved couch is now described with reference to FIGS. 1–5. Front guard 26 may be stored beneath couch on storage and retraction mechanism 31 when not needed. When it is desired to have guard 26 aligned along front couch surface 26 the user merely grasps handle 60 and sliding guard 26 from beneath couch 10 along rails 32. With guard 26 removed from beneath couch 10, guard 26 is rotated to a vertical position and attached to front surface 24 by hook 42 and eyelet 44. If desired tray 54 may be removed from the interior surface 56 of guard 26 to a position extending horizontally of seating surface 20.

It can be seen from the preceding description that a device for enclosing a portion of a seating surface of a couch which has a guard detachably connectable to the front surface of the couch, a detachable guard which covers between 15 to 50 percent of the front surface of the couch, a front guard which may be retracted and stored beneath the couch, and a tray horizontally extendable from the detachable guard has been provided.

It is noted that the embodiment of the improved couch described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a couch having a base, a first and second opposing arm rest, a back portion, a seating surface, and a front couch surface, the improvement comprising;

a front guard detachably connectable to said front couch surface for enclosing a portion of said seating surface on three sides; and a storage and retraction mechanism in connection between an underside of said base and said front guard for slidably retracting and storing said front guard beneath said base; said storage and retraction mechanism including first and second rail members rigidly connected to said underside of said base and spaced in parallel relationship, said first and second rail members each having a side forming a channel along the longitudinal axis thereof.

2. The improved couch of claim 1, further including:

a wheel rotatably connected to said front guard, said wheel being slidably entrapped within said channel.

3. The improved couch of claim 1 further including:

a tray hingedly connected to said front guard, said tray being movable from a closed position wherein said tray is disposed within said front guard to an open position extending perpendicular to said front guard.

4. The improved couch of claim 3, further including:

a first fastener connected to a tray surface of said tray; and a second fastener connected to said front guard;

said first and second fasteners being engageable for removably holding said tray in said closed position.

5. The improved couch of claim 4, wherein:

said tray surface is made of a hard, stain resistant material.

* * * * *